US008113379B2

(12) United States Patent
Cai et al.

(10) Patent No.: US 8,113,379 B2
(45) Date of Patent: Feb. 14, 2012

(54) HOT CUP LID

(75) Inventors: Liming Cai, West Chester, PA (US); Michael G. Bodary, Downingtown, PA (US)

(73) Assignee: Dopaco, Inc., Exton, PA (US)

( * ) Notice: Subject to any disclaimer, the term of this patent is extended or adjusted under 35 U.S.C. 154(b) by 351 days.

(21) Appl. No.: 12/458,035

(22) Filed: Jun. 30, 2009

(65) Prior Publication Data

US 2009/0266828 A1 Oct. 29, 2009

Related U.S. Application Data

(63) Continuation-in-part of application No. 11/513,326, filed on Aug. 31, 2006, now abandoned.

(51) Int. Cl.
*B65D 51/18* (2006.01)
*A47G 19/22* (2006.01)

(52) U.S. Cl. ..... 220/712; 220/254.3; 220/713; 220/270; 229/404; 229/906.1

(58) Field of Classification Search ..... 220/254.3, 220/712, 713, 270; 229/404, 906.1
See application file for complete search history.

(56) References Cited

U.S. PATENT DOCUMENTS

| | | | | |
|---|---|---|---|---|
| 3,994,411 | A * | 11/1976 | Elfelt et al. | 220/712 |
| 4,460,103 | A * | 7/1984 | Rama et al. | 220/254.3 |
| 5,398,843 | A | 3/1995 | Warden et al. | |
| 5,613,619 | A | 3/1997 | Van Melle | |
| 5,624,053 | A | 4/1997 | Freek et al. | |
| 5,699,927 | A | 12/1997 | Lane et al. | |
| 5,839,601 | A | 11/1998 | Van Melle | |
| 5,911,331 | A | 6/1999 | Boller | |
| 6,176,390 | B1 * | 1/2001 | Kemp | 220/712 |
| 6,260,727 | B1 | 7/2001 | Durdon | |
| D480,968 | S | 10/2003 | Atkins et al. | |
| 6,732,875 | B2 | 5/2004 | Smith et al. | |
| 6,783,019 | B2 | 8/2004 | Zettle et al. | |
| 7,011,227 | B2 | 3/2006 | Ward et al. | |

* cited by examiner

*Primary Examiner* — Anthony Stashick
*Assistant Examiner* — James N Smalley
(74) *Attorney, Agent, or Firm* — Dennison, Schultz & MacDonald

(57) ABSTRACT

A hot cup lid providing alternating modes of access to the contents of a cup, the lid including an enlarged drinking opening selectively closed by a tear flap, and a smaller sipping opening diametrically aligned with the drinking opening and adjacent the periphery of the lid, the tear flap including a sealing lug thereon engageable within and closing the sipping opening upon pivotal movement of the flap to open the drinking opening.

11 Claims, 6 Drawing Sheets

HOT CUP LID

This application is a continuation-in-part of application Ser. No. 11/513,326, filed Aug. 31, 2006 now abandoned.

BACKGROUND OF THE INVENTION

Hot beverages, normally coffee, tea or the like, are frequently sold as a takeout item and supplied in disposable cups with thin plastic lids. Such lids are generally of two types, lids which are to be removed in their entirety for access to the contents of the cup, and lids which utilize a fold-back or tear-back flap to expose a large drinking opening.

If the lid is to be removed in its entirety when consuming the contents of the cup, the lid will frequently include a sipping opening which allows the consumer to cautiously sip the beverage until such time as the coffee has sufficiently cooled to allow for a direct drinking thereof from the cup. In those lids wherein a closure flap is provided, the opening formed upon removal of the flap must be quite substantial to allow for a drinking of the coffee in a normal and rather high flow manner. Sipping through such an opening, particularly when the beverage is very hot, can be troublesome.

As consumer preferences in lids will vary, a supplier of the dispensed beverage will frequently have to stock both types of lids to meet customer requirements.

Patents of general interest with regard to the environment of the invention include Lane et al. (U.S. Pat. No. 5,699,927) wherein the lid, in addition to providing an enlarged drinking opening with a closure flap, also includes a small vent opening 74 within a rather deep recess 72 for the venting of steam. Such a steam venting hole would have no sipping capability.

Another such patent is Zettle et al. (U.S. Pat. No. 6,783,019) which, in addition to an enlarged drinking opening or spout 108 through the lid itself, also includes a straw hole 106 with a gasket 200. This hole, because of its structure specifically for the accommodation of a straw, is unlikely to be used to access hot liquids. Further, positioning of the straw opening substantially inward from the edge portion of the lid will preclude any possibility of a cautious sipping of the cup contents therethrough.

The patent to Warden et al. (U.S. Pat. No. 5,398,843) discloses a breakout section which is pushed inward to provide a drinking opening. This patent also discloses a highly restricted vent opening which is probably necessary to facilitate flow of fluid through the rather restricted drinking opening, and clearly is not intended to, and could not, as constructed, permit a sipping therethrough.

The invention has several advantages over the prior art cup lids employing a tear-back flap to expose the drinking opening and mechanisms to retain the flap in an open position for drinking the contents of the cup. It is known in the art that heat from contents of a cup can soften or distort the thermoplastic material of the cup lid, which interferes with the mechanism by which the flap is locked into place after the drinking opening is exposed. The embodiments of the invention overcome this since the sealing lug (FIGS. 1 to 4) and projecting lugs (FIGS. 5 to 9) are located on a tab that is beyond the outer periphery of the lid and thus remote from the heat of the contents of the cup.

Further, the location of the sealing lug or projecting lugs on the tab that is external to the lid rim means that the contents of the cup do not come into contact with the underside of the tab. This is an important improvement over the prior art cup lids because it ensures that the drinker's fingers will not come into contact with the cup's contents as the drinker tears back the flap and presses down on the area directly beneath the tab to engage the flap in an open position on the lid. Such is not the case in prior art cup lids where the lugs or locking protrusions used to secure the flap in an open position are located inside the outer periphery of the lid and thus exposed to the contents of the cup.

SUMMARY OF THE INVENTION

The present invention is particularly directed to a multiple function cup lid which can, at the option of the user, allow a controlled sipping, as would be desirable when the contents of the cup are too hot for a conventional drinking, and an unrestricted drinking of the contents as the liquid cools. The capability of the single lid of the invention to provide for two modes of direct access to the contents of a hot container, without removal of the lid, avoids the necessity of providing a separate lid for each drinking mode. Rather, both modes are accommodated by a unique single lid.

Basically, the lid, formed of a conventional thermoplastic material or the like, provides a tear-back flap joined by an integral or living hinge to a central portion of the lid body. The flap, when closed and prior to tearing or breaking away, has an outer rim portion defining a downwardly opening cavity which frictionally engages the conventional beaded lip of a cup. The remainder of the lid has a similarly configured peripheral rim for sealing of the entire lid to the container or cup. The flap, when a drinking of the contents of the cup is desired, will, through a lifting of the rim portion of the flap, break away and pivot rearwardly. This will expose the lip of the cup itself for a direct engagement of the user's lips with the cup lip and a direct drinking of the contents, as would be the case were the entire lid removed, while still retaining a substantial protective enclosure of the cup contents.

The lid, in an area diametrically aligned with the flap, also includes a raised ridge at the outer periphery of the lid. This ridge is provided with the sipping opening therethrough aligned with the tear flap. The positioning of the sipping opening, in the raised portion or ridge, positions the sipping opening substantially above the maximum fill line of the cup, normally at or slightly below the beaded lip thereof. In addition, the ridge uniquely provides for a convenient access to the sipping opening by the mouth of the drinker with the lips positioned to each side thereof for controlled access to the contents in the sipping mode.

When drinking through the drinking opening, it may be desirable to close the sipping opening which, while relatively small, is clearly larger than a restricted vent opening through which accidental discharge is not normally a problem. Accordingly, a projecting tab is integrally formed with the rim portion of the flap and extends beyond the rim forming periphery of the lid. This tab, upon an opening of the flap and a swinging of the flap fully backward, will engage over and close the sipping opening. This closing of the sipping opening is enhanced and an effective seal thereof provided, by a projecting lug on the tab configured to conform to the configuration of the sipping opening for a snug engagement therein. The engagement of the lug in the sipping opening will also act so as to hold the flap in its open position.

In an alternative embodiment of the invention, the lid provides a tear-back flap joined by an integral or living hinge located closer to the rim portion of the lid than in the first embodiment. A flap retaining ridge integrally formed in a recess in the central portion of the lid body is configured to conform to the configuration of a pair of projecting lugs integrally formed on the tab for a snug engagement thereon. The projecting lugs, upon an opening of the flap and a swinging of the flap backward about the pivot point of the living hinge, will engage over and be retained by the flap retaining ridge. The engagement of the pair of lugs on the flap retaining ridge will act so as to hold the flap in its open position.

Further objects and features of the invention will become apparent from the detailed description of the invention following hereinafter.

DESCRIPTION OF THE PREFERRED EMBODIMENTS

Figure 1:
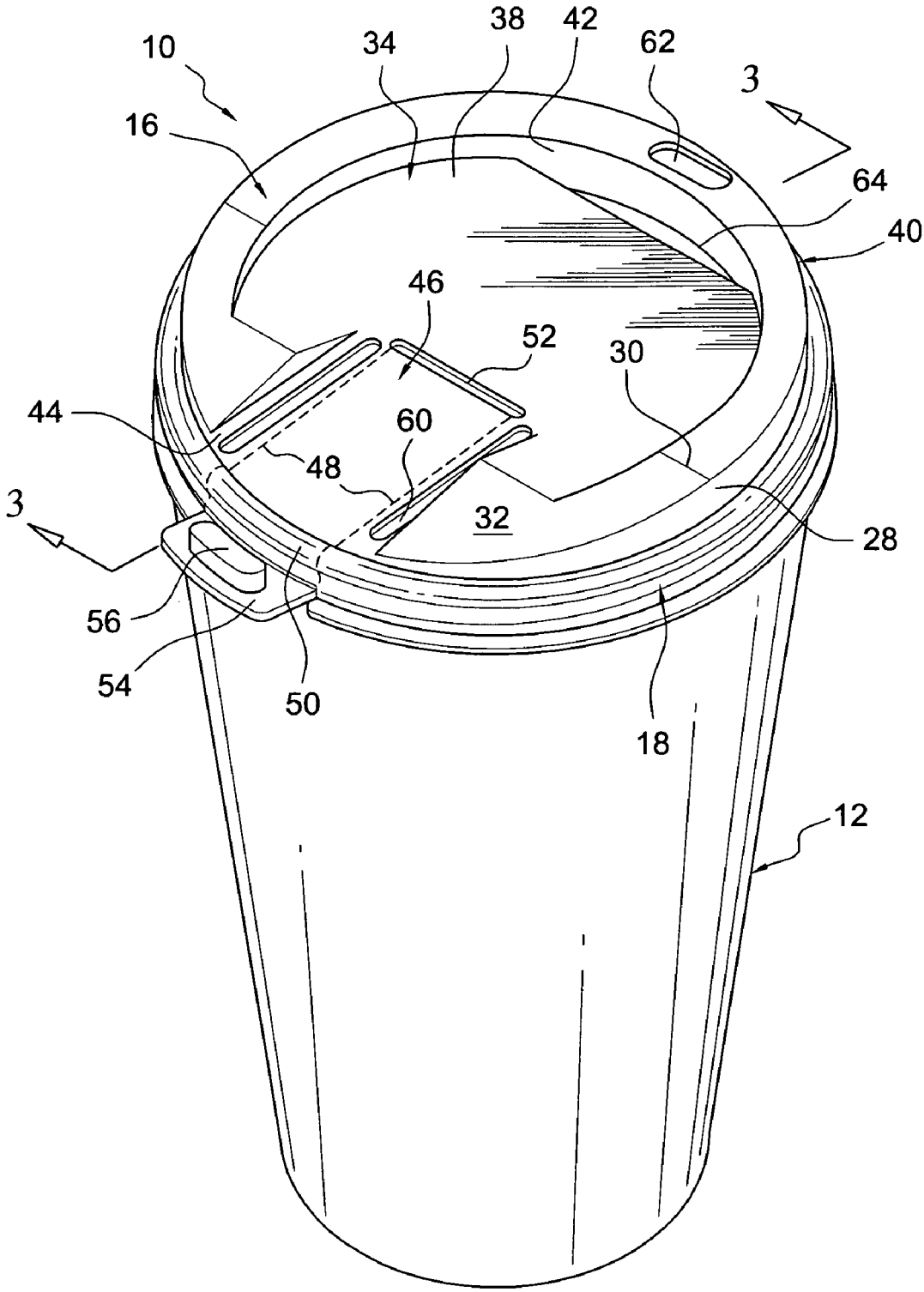
FIG. 1 is a top perspective view of the lid of the invention mounted to a hot cup with the tear flap closed and with the sipping opening open.
Figure 2:
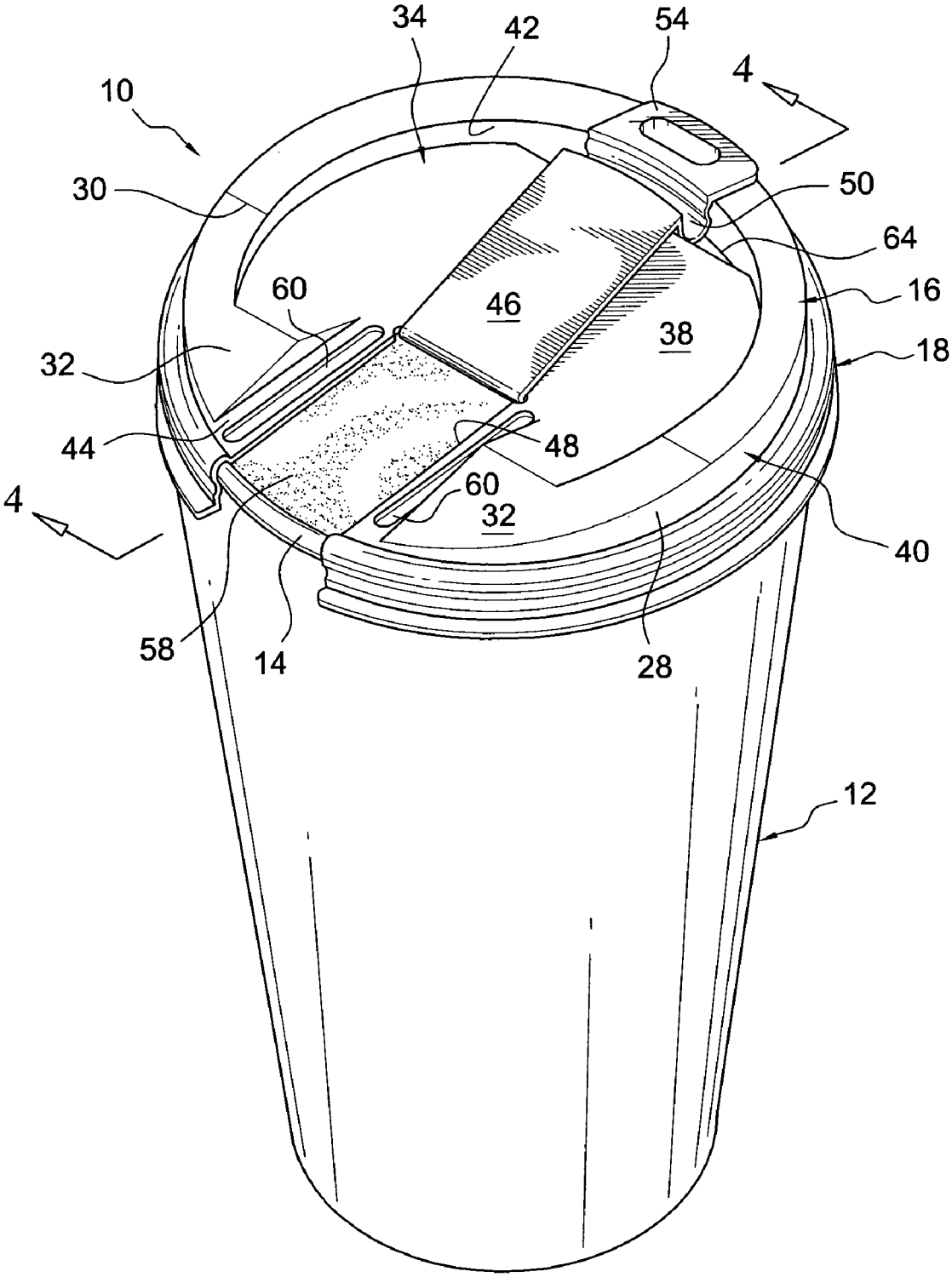
FIG. 2 is a similar perspective view with the tear flap released and pivoted rearwardly to overlie the lid and seal the sipping opening.
Figure 3:
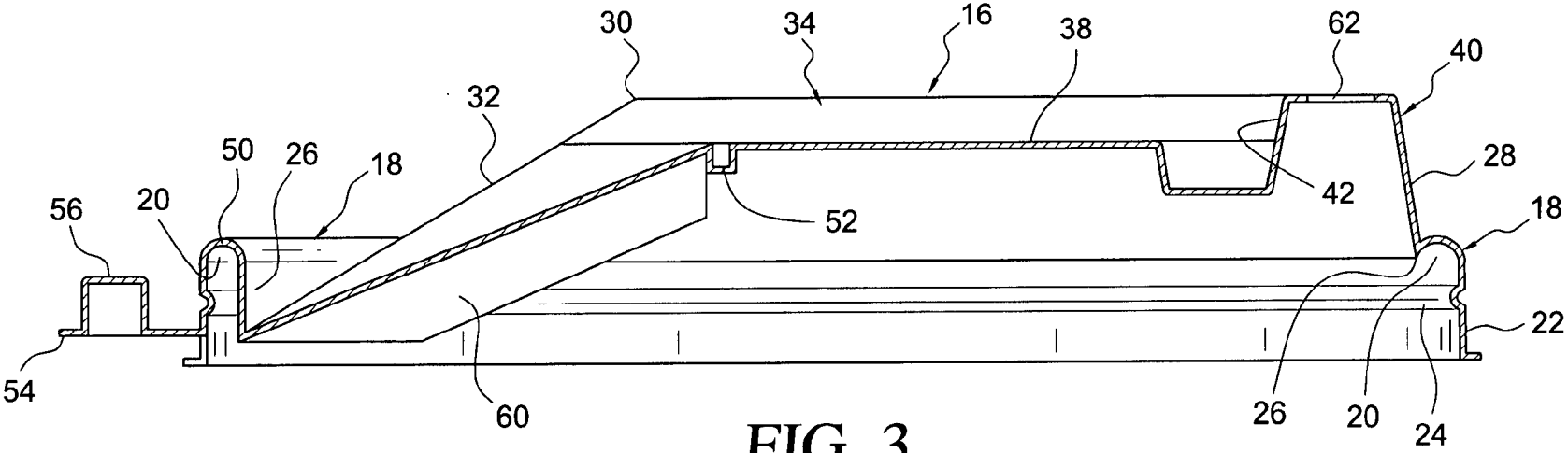
FIG. 3 is an enlarged cross-sectional detail of the lid itself taken substantially on a plane passing along line 3-3 in FIG. 1 with the flap in its closed position.

Referring now more specifically to the drawings, the hot cup lid 10 of the invention is illustrated, in FIGS. 1 and 2, engaged over the open mouth of a hot cup 12. The cup 12, in the manner of conventional hot cups, includes an outwardly rolled edge about the open mouth thereof which defines a cup lip 14. The lid 10 includes a top or top panel 16 and a peripheral rim 18 adapted to snap-mount and seal to the cup lip. The lid rim 18, noting FIGS. 3 and 4, includes a downwardly directed cavity 20 which seats on the cup lip 14, an outer skirt 22, preferably including an inwardly directed locking bead 24, and an inner rim skirt 26 defining the cavity 20 and engageable against the inner surface of the cup 12.

The height of the top 16 above the peripheral rim 18 varies from a maximum height with a side wall 28 extending between the top 16 and the inner rim skirt 26 therebelow to a generally diametrically opposed position wherein the top 16 engages directly with the inner rim skirt 26 substantially below the cavity 20 defined thereby. Basically, the top 16 is of a constant height for a substantial portion of the lid 10 and, at a break point indicated by 30, slopes, as indicated at 32, progressively downward, to the rim, with a corresponding progressive decrease in the height of the lid side wall 28. Note, in particular, the left side of the cross-sectional details of FIGS. 3 and 4.

The lid 10 includes a central recess 34, the depth of which below the top 16 is such whereby the bottom 38 of the recess 34 is positioned substantially above the peripheral rim 18. The recess 34 is of a size and so configured as to define or retain a peripheral ridge 40 about a major portion of the lid, including the full height portion thereof and an extent of the downwardly sloping area 32 (note, in particular, FIGS. 1 and 2). This ridge 40 is defined by the flat top 16, the side wall 28 and an inner wall 42 which also defines the peripheral wall of the recess 34.

A flap-accommodating channel 44 extends radially outward from the relatively higher recess bottom 38 centrally through the sloping portion of the top 16 to the cup rim 18.

A tear flap 46 extends centrally along the channel 44 and is defined by laterally spaced parallel tear or break lines 48 in and along the bottom of the channel 44 and through the aligned section or portion 50 of the lid rim 18. The inner end of the flap 46 is pivotally joined to the bottom 38 of the recess by an appropriate living hinge 52. The flap also includes an integral tab 54 on and projecting outward from the outer skirt portion of the rim portion 50 of the flap, with this tab 54 having an upwardly projecting sealing lug 56 thereon.

The flap 46, when one desires to drink from the cup 12, is grasped by the tab 54 and upwardly and rearwardly pivoted, causing a parting of the tear or break lines 48 as well as a disengagement of the rim portion 50 integral therewith. The drinking opening thus formed is of a substantial size and, by a removal of the rim portion 50 with the flap, exposes the cup lip 14 for direct access thereto by the drinker, much in the manner of drinking from an open top cup. This substantially free access to the contents of the cup will also be facilitated by the inclined nature of the portion 32 of the top, which allows for an accommodation of the upper lip of the drinker. As desired, the bottom of the channel 44 can be strengthened or stabilized immediately outward of the tear lines 48 by a pair of downwardly directed ribs 60 formed therein and paralleling the tear lines 48 for a major portion of the length thereof.

The top 16, and more particularly the flat top ridge portion thereof formed by the recess 34, at a point diametrically opposed from the flap and drinking opening 58 formed thereby, includes a sipping opening 62 therethrough. This sipping opening 62 is, as opposed to the drinking opening 58, of a size so as to allow for a controlled sipping of the hot contents of the cup therethrough until such time as the contents have sufficiently cooled so as to allow for a conventional drinking thereof through the drinking opening 58. It will be noted that this sipping opening 62 is provided immediately adjacent the outer periphery of the lid for convenient and safe access thereto and to the hot liquid to issue therefrom in a controlled manner. Further, the ridge 40 within which the sipping opening 62 is defined, allows for a convenient positioning of the mouth of the drinker when accessing the sipping opening. The elevated positioning of the sipping opening 62 at the uppermost position of the lid, will also provide for at least a small cooling effect as the hot liquid flows through the lid to the sipping opening.

Figure 4:
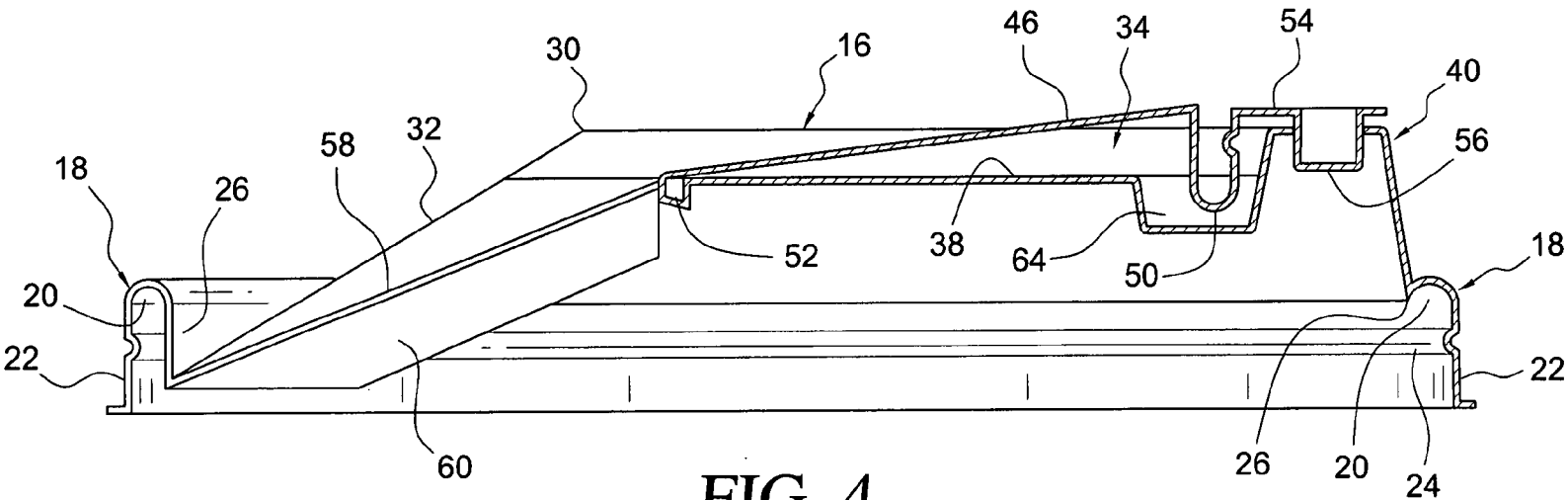
FIG. 4 is an enlarged cross-sectional detail through the lid itself taken substantially on a plane passing along line 4-4 in FIG. 2 and illustrating the flap in its open position.
Figure 5:
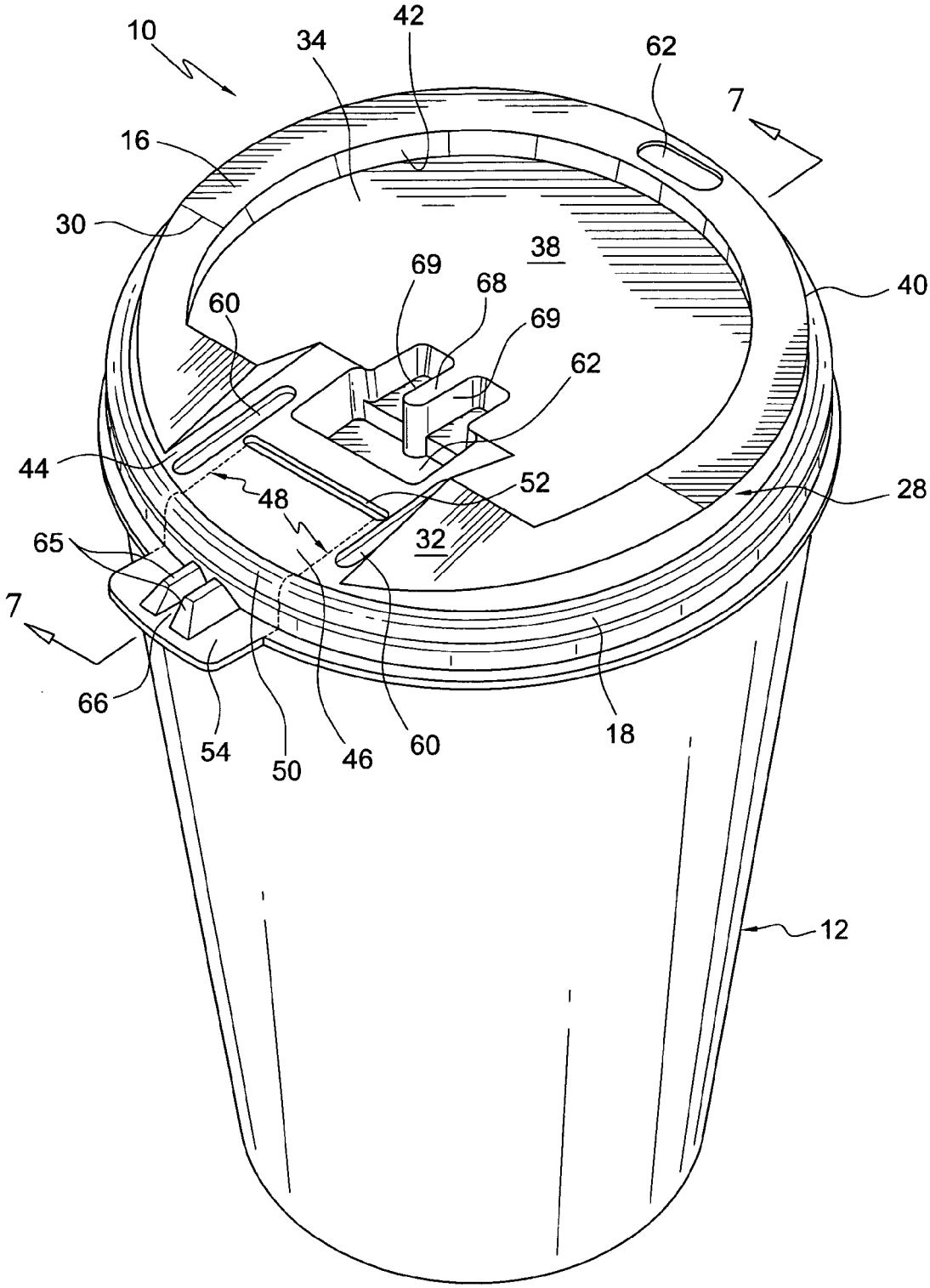
FIG. 5 is a top perspective view of the lid of a second embodiment of the invention mounted to a hot cup with the tear flap closed.

Referring to FIGS. 2 and 4 in particular, when the larger drinking opening 58 is to be accessed, the flap 46 is upwardly and rearwardly pivoted and releasably retained in its open position by engagement of the lug 56 on the tab 54 within the sipping opening 62. The sipping opening and lug are of complimentary configurations whereby the lug completely seals the sipping opening to prevent any accidental discharge therefrom as the drinking opening 58 is accessed. Further, in order to accommodate the projecting rim section 50 integral with the flap 46, and thus not interfere with the sealing engagement of the lug 56 within the sipping opening 62, a pocket or pocket area 64 will be provided at the rear of the recess 34 immediately forward of the ridge 40 within which the sipping opening 62 is defined. The pocket 64, as will be readily recognized, is appropriately aligned to receive the rim section 50. It will also be recognized that this pocket 64, will provide for a further accommodation of the lid to the drinker's mouth as the sipping opening is accessed.

Inasmuch as the flap 46 incorporates a section or portion 50 of the locking rim 18, the flap can be reclosed for a substantially resealing of the drinking opening.

In an alternative embodiment of the invention, illustrated in FIGS. 5 to 9, the inner end of the flap 46 is pivotally joined by an appropriate living hinge 52 to the bottom of the flap-accommodating channel 44. The tab 54 has located thereon a pair of projecting lugs 65 which extend upwardly from the top surface of the tab 54. The opposing inner walls of the projecting lugs 65 extend perpendicularly with respect to the plane of the top surface of tab 54 and define a ridge-accommodating channel 66 therethrough.

A well or well area 67 is formed in an area extending from a portion of the flap-accommodating channel 44 to a portion of the central recess 34, and includes a flap retaining ridge 68 extending radially in line with the sipping opening 62 and ridge-accommodating channel 66.

Figure 6:
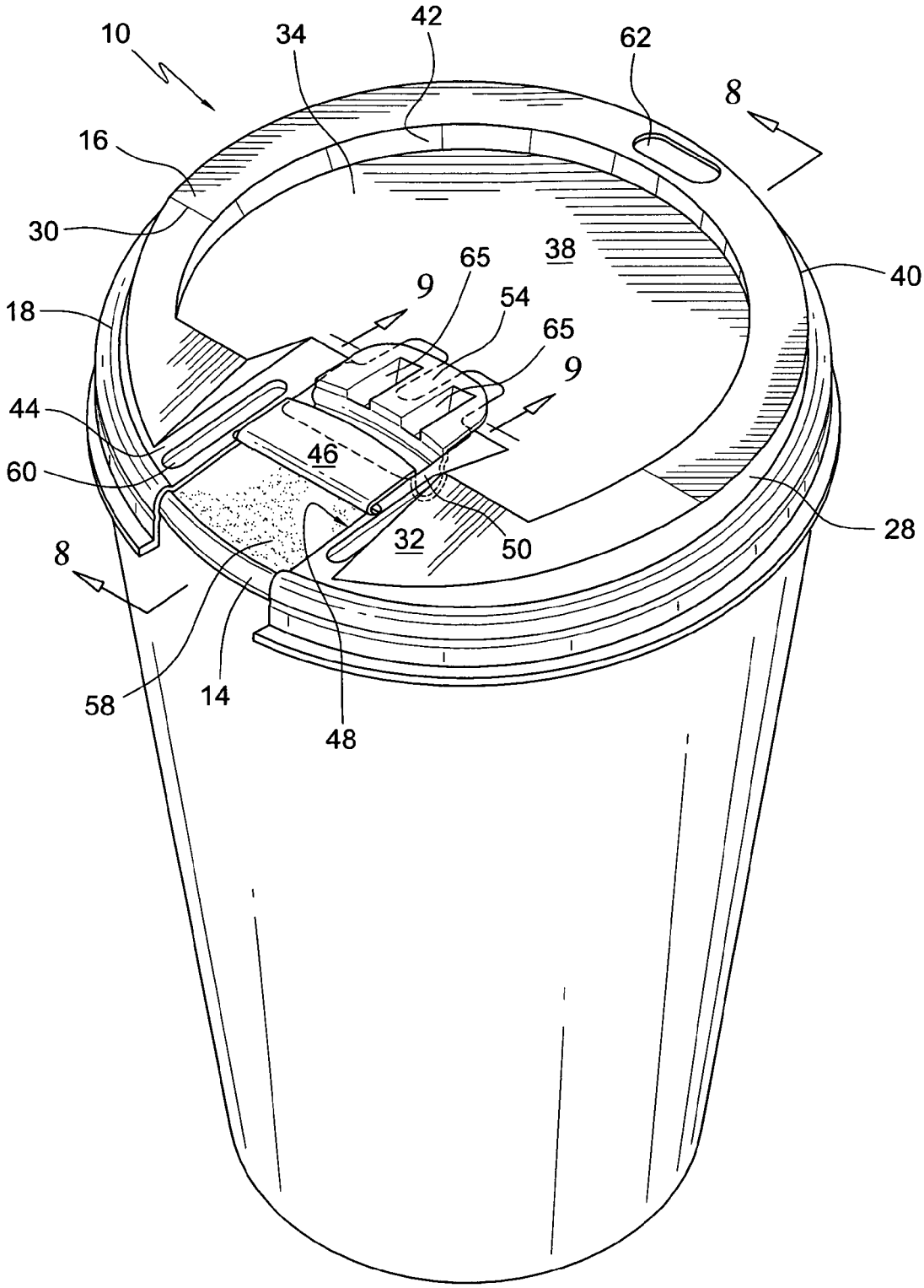
FIG. 6 is a similar perspective view with the tear flap released and pivoted rearwardly to overlie the lid and engage the projecting lugs on the flap retaining ridge.
Figure 7:
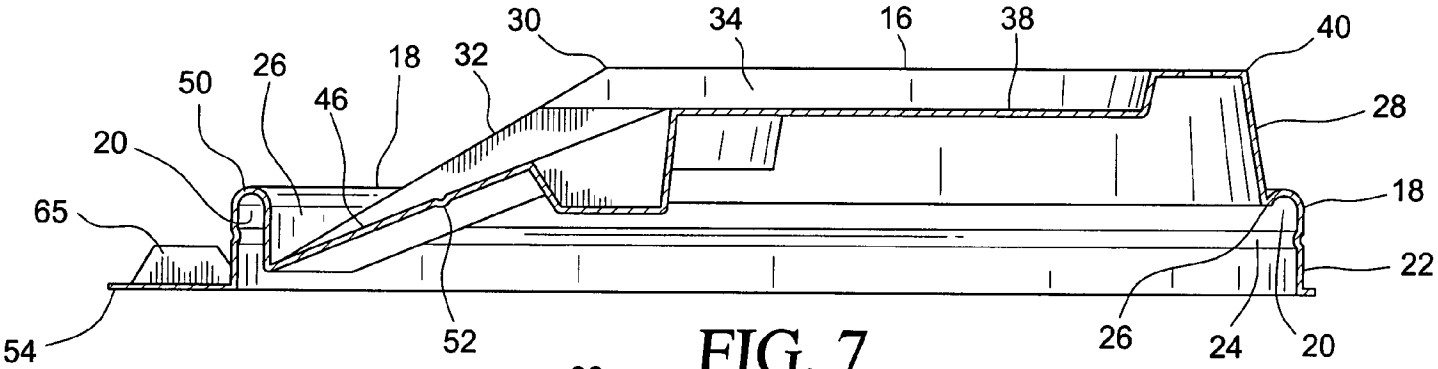
FIG. 7 is an enlarged cross-sectional detail of the lid itself taken substantially on a plane passing along line 3-3 in FIG. 5 with the flap in its closed position.
Figure 8:
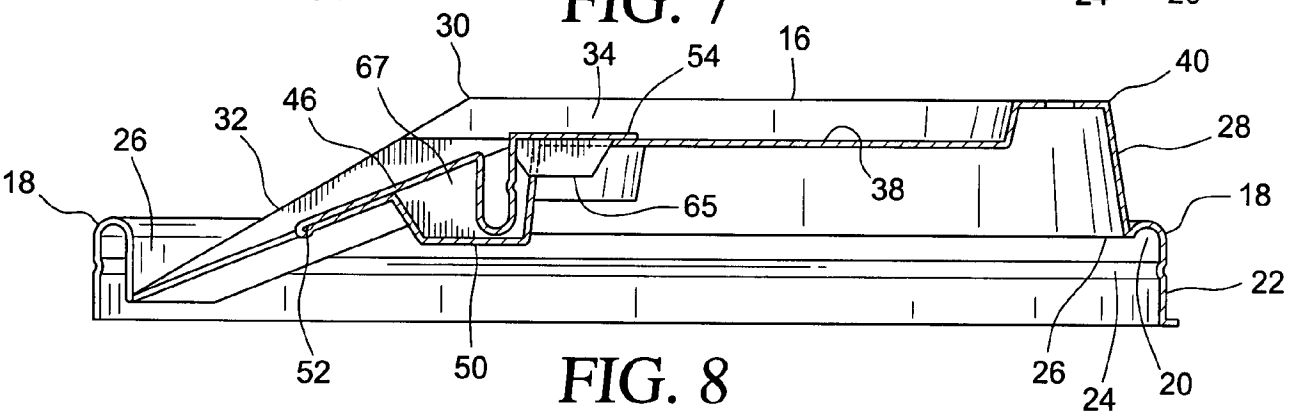
FIG. 8 is an enlarged cross-sectional detail through the lid itself taken substantially on a plane passing along line 4-4 in FIG. 6 and illustrating the flap in its open position.
Figure 9:
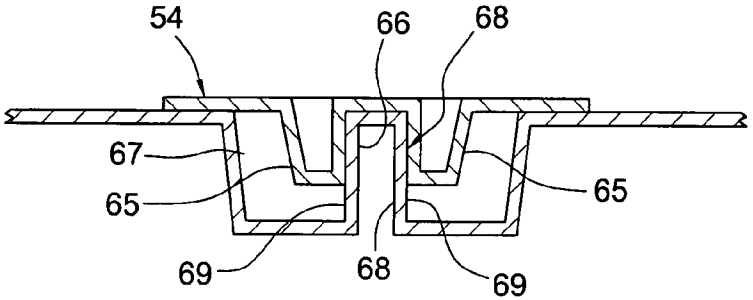
FIG. 9 is an enlarged cross-sectional detail through the lid itself taken substantially on a plane passing along line 5-5 in FIG. 6 and illustrating the engagement of the projecting lugs on the flap retaining ridge with the flap in its open position.

Referring to FIGS. 6, 8, and 9 in particular, when the larger drinking opening 58 is to be accessed, the flap 46 is upwardly and rearwardly pivoted and releasably retained in its open position by frictional engagement of the ridge-accommodating channel 66 on the flap retaining ridge 68. A snug retention of the flap 46 in the open position is achieved as the inner and vertical opposing walls of the ridge-accommodating channel 66 engage the radially extending walls of the flap retaining ridge 68 (FIG. 9).

Further, the depth of the well or well area 67 is such that it accommodates the projecting rim section 50 integral with the flap 46, thus preventing interference of the engagement of the ridge-accommodating channel 66 with the flap retaining ridge 68. The well 67, as will be readily recognized, is appropriately aligned to receive the rim section 50. The depth of the portion of the well 67 adjacent the flap retaining ridge 68 may be shallower than the portion of the well 67 that receives the rim section 50, this depth being governed by the height of the downwardly projecting lugs 65 on the tab 54.

In this embodiment of the invention, it will be appreciated that, at the option of the drinker, both the larger drinking opening 58 and the smaller sipping opening 62 of the lid may remain accessible to the contents of the cup at the same time. Further, it will be noted that the size of the drinking opening 58 is smaller in the embodiment of the invention illustrated in FIGS. 5 to 9 compared to the embodiment illustrated in FIGS. 1 to 4.

It should also be appreciated that the hot cup lid of the invention can be formed of any appropriate thermoplastic or like material standard in the formation of cup lids and which will allow for the provision of tear or break lines, a living hinge, and a snap mounting of the lid rim and flap rim portion to a conventional hot cup.

As described, the lid is unique in its multi-functional capacity, providing, at the option of the drinker, a sipping of the contents of the cup through a small sipping opening upwardly removed from the fill level of the cup, and, upon a sufficient cooling of the cup contents to the drinker's preference, a direct drinking through an enlarged drinking opening provided in the lid which exposes the cup lip itself and provides direct access to the contents thereof as one would have in an open mouth cup. This is achieved while at the same time retaining a partial enclosure of the cup to maintain the warmth thereof and avoid accidental spillage.

The foregoing is considered illustrative of the principles of the invention. As modifications and variations may occur to those skilled in the art, it is not desired to limit the invention to the exact construction and manner of use as shown and described. Rather, all suitable modifications and equivalents may be resorted to as falling within the scope of the invention as claimed.

The invention claimed is:

1. A hot cup lid for mounting on a hot cup and providing alternate modes of accessing the contents of the cup, said lid comprising:

a drinking opening defined therethrough for direct drinking access to the contents of an underlying cup;

a tear flap joined to said lid for movement between a closed position overlying and closing said drinking opening, and an open position opening said drinking opening;

a sipping opening through said lid remote from said drinking opening, said sipping opening being substantially smaller than said drinking opening;

a peripheral rim including a downwardly directed cavity with an outer skirt adapted to engage and seal to the lip of an open mouth cup, said flap including an aligned section of said peripheral rim;

a top portion including a well disposed in said top portion, said well including a flap retaining ridge;

a tab integral with said peripheral rim and projecting outwardly therefrom beyond the outer periphery of said lid; and a pair of upwardly projecting lugs on said tab, said lugs having a configuration complementary to the flap retaining ridge and well for retention of said lugs on said flap retaining ridge in the open position of said flap.

2. The hot cup lid of claim 1 wherein said flap is hinged to said lid and pivots between said closed and open positions.

3. The hot cup lid of claim 1 wherein said top portion includes a central recess defining a raised peripheral ridge, and wherein said sipping opening is defined through said raised peripheral ridge.

4. The hot cup lid of claim 3 wherein at least a portion of said peripheral ridge is diametrically opposed from said drinking opening and flap and adjacent the rim of said lid, said sipping opening being defined through this portion of said peripheral ridge.

5. The hot cup lid of claim 3 including a flap accommodating channel in said top extending from said central recess through said top to said peripheral rim, said channel having a bottom inclined downwardly from said central recess to said peripheral rim, and laterally spaced tear lines along a portion of the length of said bottom and extending through the aligned rim section to define said flap.

6. The hot cup lid of claim 5 wherein said channel bottom has strengthening ribs defined therein.

7. The hot cup lid of claim 1 wherein said well is formed in an area extending from a portion of the flap-accommodating channel to a portion of the central recess.

8. The hot cup lid of claim 1 wherein said well receives therein the rim portion component of said flap as said flap moves to the open position with said lugs engaged on said flap retaining ridge.

9. A hot cup lid for an open mouth drinking cup having a drinking lip about the mouth thereof, said lid comprising:

a peripheral rim adapted to engage and seal to the cup lip;

a tear-back flap extending radially inward from said rim to a central area of said lid, said flap including a portion of the rim aligned therewith;

said flap being hinged to said central area for selective exposing of a portion of said cup lip and defining a drinking opening inward thereof for direct drinking access to the cup contents;

said flap having an integral tab thereon extending outwardly beyond the rim portion, said lid, generally diametrically opposed from said flap, including a sipping opening defined therethrough;

a top, a central recess in said top defining a ridge, at least a portion of said ridge being diametrically opposed to said drinking opening and flap, said ridge being defined immediately adjacent the rim of said lid, said sipping opening being defined in said ridge;

a well in said top, said well including a flap retaining ridge; and a pair of upwardly projecting lugs on said tab, said lugs having a configuration complementary to said flap retaining ridge and well for retention of said lugs on said flap retaining ridge in the open position of said flap.

10. The hot cup lid of claim 9 wherein said well receives therein the rim portion component of said flap as said flap moves to the open position with said lugs engaged on said flap retaining ridge.

11. The hot cup lid of claim 9 including a flap accommodating channel in said top extending from said central recess through said top to said peripheral rim, said channel having a bottom inclined downwardly from said central recess to said peripheral rim, and laterally spaced tear lines formed along a portion of the length of said bottom and extending through said rim to define the aligned rim portion and, upon severing, define said flap.

* * * * *